US005943301A

United States Patent [19]

Igarashi

[11] Patent Number: 5,943,301

[45] Date of Patent: Aug. 24, 1999

[54] ELECTRONIC TIMEPIECE WITH POWER GENERATING FUNCTION

[75] Inventor: Kiyotaka Igarashi, Tokyo, Japan

[73] Assignee: Citizen Watch Co., Ltd., Tokyo, Japan

[21] Appl. No.: 08/930,409

[22] PCT Filed: Jan. 30, 1997

[86] PCT No.: PCT/JP97/00214

§ 371 Date: Dec. 8, 1997

§ 102(e) Date: Dec. 8, 1997

[87] PCT Pub. No.: WO97/28491

PCT Pub. Date: Aug. 7, 1997

[30] Foreign Application Priority Data

Jan. 30, 1996 [JP] Japan ..... 8-014008

[51] Int. Cl.[6] ..... G04B 1/00

[52] U.S. Cl. ..... 368/204; 368/203

[58] Field of Search ..... 368/200, 201, 368/202, 203, 204, 205

[56] References Cited

FOREIGN PATENT DOCUMENTS 510732 10/1992 European Pat. Off. ..... 368/205

2158274 11/1985 United Kingdom ..... 368/205

*Primary Examiner*—Bernard Roskoski

*Attorney, Agent, or Firm*—Greer, Burns & Crain, Ltd.

[57] ABSTRACT

In a charged-type watch, because the power supply voltage varied when moving the hand in reverse, preventing precise reverse hand movement, a charging prohibiting means is provided which only operates when performing reverse operation, so that a charging means is not charged during reverse operation.

15 Claims, 7 Drawing Sheets

ELECTRONIC TIMEPIECE WITH POWER GENERATING FUNCTION

FIELD OF THE INVENTION

The present invention relates to an improvement in the reliability of reverse hand movement in an analog multifunction electronic watch which has a hand that is linked to a motor that can run forward and in reverse and which displays the time as well as another function other than the time, and which also has as a power supply and an electrical storage means which stores electrical energy that is generated by an external electrical generating means.

BACKGROUND OF THE ART

An analog multifunction watch which has a motor that can run forward and in reverse and which uses a primary cell such as a silver battery or a lithium battery has already been developed as a product. General functions of an analog multifunction watch include an alarm function, a chronograph function, and a timer function and the like.

A product has also been developed in the form of a charged-type watch which uses a combination of an external electrical generating means such as a solar cell or an automatic winding electrical generator and either a two-layer large-capacity capacitor or a secondary cell.

However, the analog charged-type watches of the past were only single-function types which merely move the hour, minute, and second hands every one second, and even if they had some function added, it was limited to a calendar function which is a linked day-of-the week plate.

In a single-function watch, it is sufficient to run the hands in the forward direction only. However, in a multifunction watch, to shorten the time required for switching between modes and for correcting the hand positions, in addition to forward hand movement, it has become necessary to run the hands in reverse as well.

By using a load compensation system as disclosed in the Japanese Unexamined Patent Publication (KOKAI) No. 61-18151 (in which when rotation by a drive pulse fails, rotation is effected by outputting a larger compensation pulse) even if there is a variation in voltage in the forward drive pulse for the purpose of driving hands forward, the position indicated by the hands was not skewed.

Therefore, in a charged-type watch, even if an electrical storage means is charged during forward hand movement, there was no particular problem.

However, based on the principle disclosed in Japanese Unexamined Patent Publication (KOKAI) No. 52-80063, a reverse pulse which moves the hands in reverse does not have the compensation pulse of the forward pulse. Therefore, in a charged-type watch, if the electrical storage means is charged during reverse hand movement, so that the voltage varies, it was not possible to compensate the rotation.

DISCLOSURE OF THE INVENTION

An object of the present invention is to provide a multifunction electronic watch with electrical generating means, which includes an analog multifunction watch and a digital multifunction watch which improves on the above-noted problems with the prior art, and wherein electrically generated energy generated from an electrical generating means is not stored in an electrical storage means during the time in which the electronic watch is displaying a function other than the time display, and wherein when the abovenoted reverse pulse is output or when the reverse pulse is used, the output voltage is stabilized, so that the rotation of the hand-moving motor can be stabilized.

To attain the object of the present invention, an electronic watch having an electric generating function according to the present invention has the following basic technical constitution.

Specifically, an electronic watch such as either an analog multifunction watch or a digital multifunction watch according to the present invention, having a motor which can be run forward and in reverse, and has hands that are linked to the motor, includes a function selecting means which selectively causes to operate either the time display function or a function other than the time display function. The watch includes-an external electrical generating means and an electrical storage means which stores electrical energy generated by the external electrical generating means, and a charging condition control means which, in response to at least one selection signal output from the function selecting means which selects a function other than the time display function, performs control of the charging condition in the charging means which is charged by the generated electrical energy from the external electrical generating means.

More specifically, an electronic watch with an electrical generating function according to the present invention is, for example, an analog-type multifunction electronic watch which makes use of a configuration that enables switching of indicating hands, which are linked to a motor that can run forward and in reverse, between a time display and a display function other than the time display. The watch also has an external electrical generating means, an electrical charging means which stores electrical energy generated by the above-noted electrical generating means, a reverse-flow preventing means for the purpose of preventing the reverse flow of energy stored in the above-noted electrical charging means, a reverse control means which controls the reverse movement of the hands, and a charging prohibiting means which performs control so that the generated electrical energy from the above-noted external electrical generating means does not charge the charging means, in accordance with a signal from the above-noted reverse control means.

PREFERRED EMBODIMENTS OF THE PRESENT INVENTION

Preferred embodiments of an electronic watch having an electrical generating function will be described below, with reference being made to the drawings.

Figure 1:
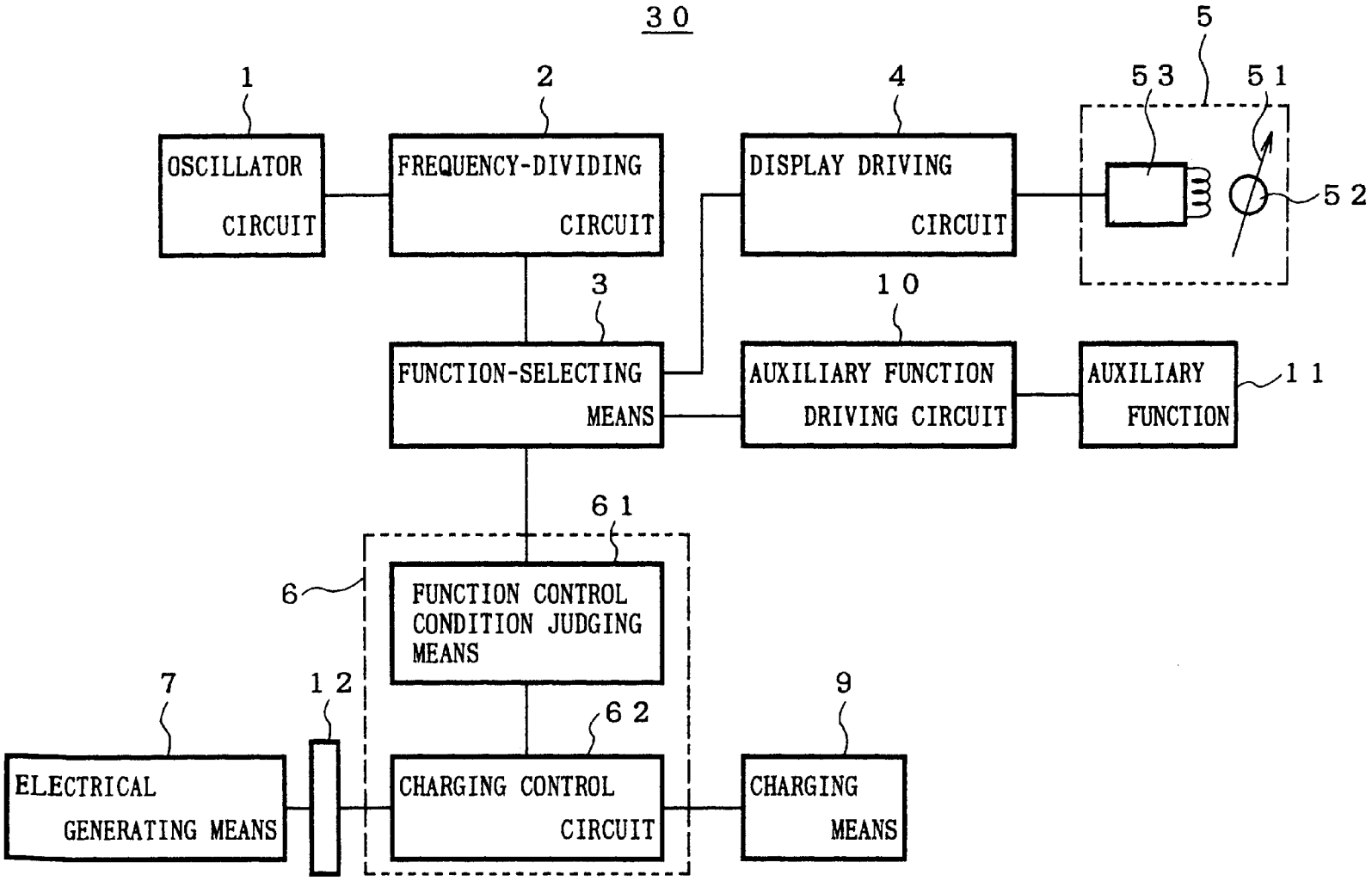
FIG. 1 is a block diagram which shows the general configuration of the first embodiment of an electronic watch having an electric generating means according to the present invention.

FIG. 1 is basic block diagram which shows the basic configuration of an electronic watch 30 having an electrical generating means according to the present invention, for the case in which this watch is an analog-type multifunction electronic watch.

In this drawing, the analog-type electronic watch 30 is formed by a motor 52 which can run forward and in reverse, an analog display device 5 formed by an indicating hand 51 that is linked to the motor 52, and a function selecting means 3 which causes selective display of the time display function and another function other than the time display function in the display means 5. This watch further has an external electrical generating means 7, a charging means 9 which stores electrical energy that is generated by the external electrical generating means 7, and charging condition controlling means 6, which, in response to a selection signal from the function selecting means 3 which selects a function different from the time display function, performs control of the charging condition in the charging means 9 which is charged by the generated electrical energy from the external electrical generating means 7.

The first embodiment of the present invention as shown in FIG. 1 further has an oscillation means 1 formed by a quartz crystal oscillator or the like which serves as the reference timebase source, a frequency-dividing means 2 which is used for the purpose of appropriately lowering the frequency of oscillation of the above-noted oscillation means 1, and a display driving means 4 which drives the above-noted display device 5 in response to a function selecting signal from the above-noted function selecting means 3. The above-noted charging condition control means 6 is formed by a function control condition judging means 61 which performs a judgment with regard to the function control condition of the above-noted display device 5 in accordance with a function selecting signal that is output from the function selecting means 3, and a charging control means 62 which, in response to the output of the above-noted function control condition judgment means 61, controls the conduction condition between the above-noted external electrical generating means 7 and the above-noted charging means 9.

Essentially, in an electronic watch 30 having an electrical generating function according to the present invention, when the function selecting means 3 issues a command to the display driving means 4 so that the reversible motor 52 of the display device 5 drives the hand in reverse, the function control condition judging means 61 of the charging condition control means 6 detects the contents of that command, causing the charging control means 62 to operate, thereby cutting off the conduction between the external electrical generating means 7 and the charging means 9.

Additionally, in this embodiment, the functions other than the time display function that can be selected by the function selecting means 3 are at least one function selected from a set of functions such as a fast-forward hand movement function, a hand reverse-movement function, a fast-reverse hand movement function, an alarm function, a chronograph function, a timer function, a stopwatch function, and a radio signal receiving function and the like.

Of the functions other than the time display function, functions such as an alarm function and a radio signal receiving function, do not make use of the motor or hands of the display device 5. When driven, These functions can be distinguished from other non-time-display functions as auxiliary functions, and it is possible as shown in FIG. 1, to provide an auxiliary function executing means 11 separate from the display device 5, so that when the function selecting means 3 selects an auxiliary function, the auxiliary function executing means 11 is driven via an appropriate auxiliary function driving means 10.

In this case as well, it is desirable that operation be done so as to cut off the conduction between the external electrical generating means 7 and the charging means 9.

While there is no particular limitation imposed with regard to the charging control means 62, it is desirable that it be made up of at least one elements such as an appropriate switching circuit, variable-resistance circuit, or electrical storage circuit or the like.

As noted above, in the present invention, the charging condition control means 6 is configured so as to prevent the charging of the charging means 9 by either part of or all of the energy generated from the external electrical generating means 7.

In the above-noted electronic watch 30 having an electrical generating function according to the present invention, when a function other than the time display function is being displayed, it is desirable that the configuration be made so that the above-noted load compensation system is set so as not to operate.

Additionally, in the present invention, it is desirable that a reverse-flow preventing means 12 be further provided between the external electrical generating means 7 and the charging means 9 so as to prevent the reverse flow of electrical energy stored in the charging means 9.

This reverse-flow preventing means 12 can be, for example, a diode or the like.

Although in the example shown in FIG. 1 the reverse-flow preventing means 12 is provided in between the charging condition judging means 6 and the external electrical generating means 7, the present invention does not impose a limitation to this configuration, and it is possible also to provide the reverse-flow preventing means in between the external charging condition judging means 6 and the charging means 9.

Figure 2:
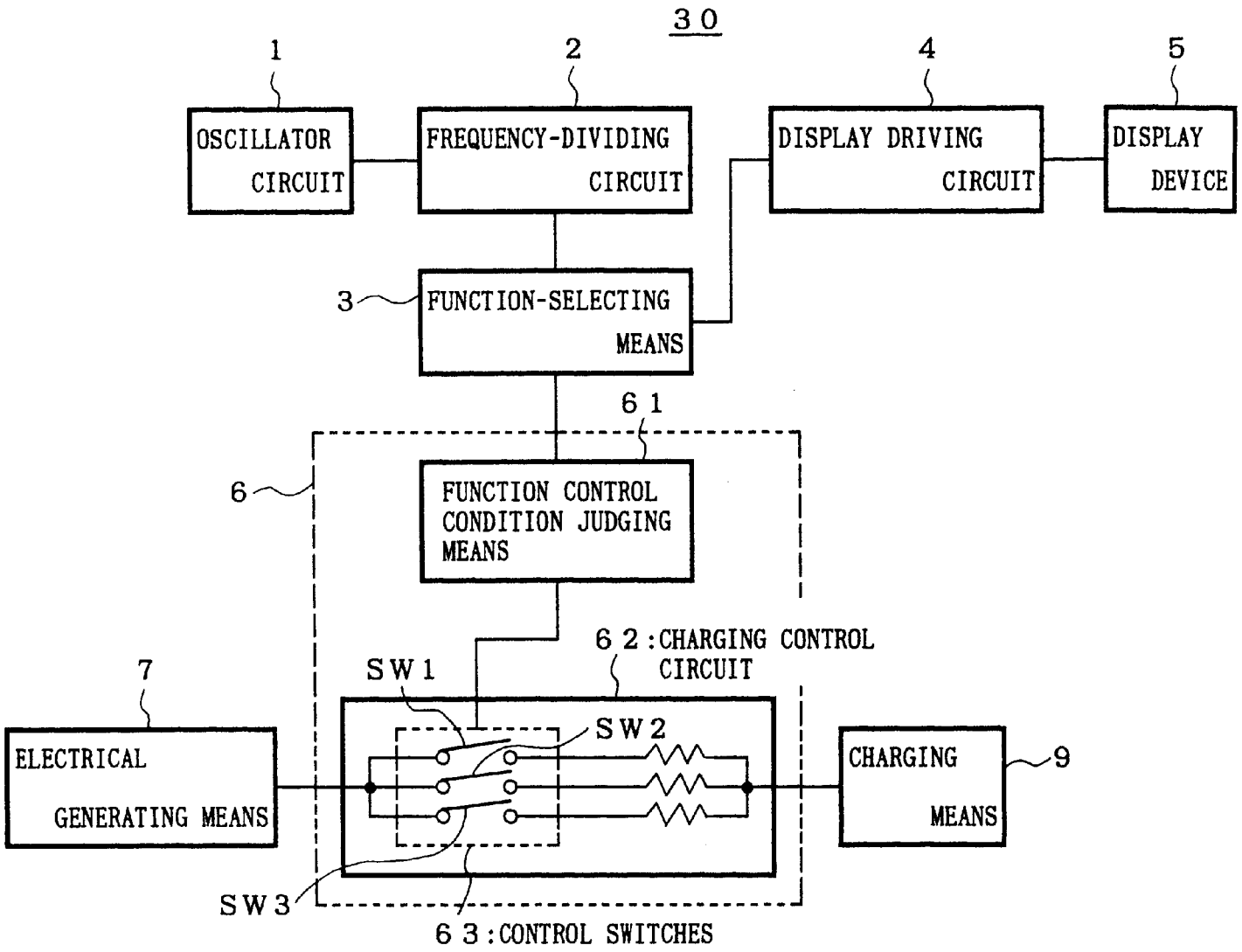
FIG. 2 is a block diagram which shows the general configuration of the second embodiment of an electronic watch having an electric generating means according to the present invention.
Figure 3:
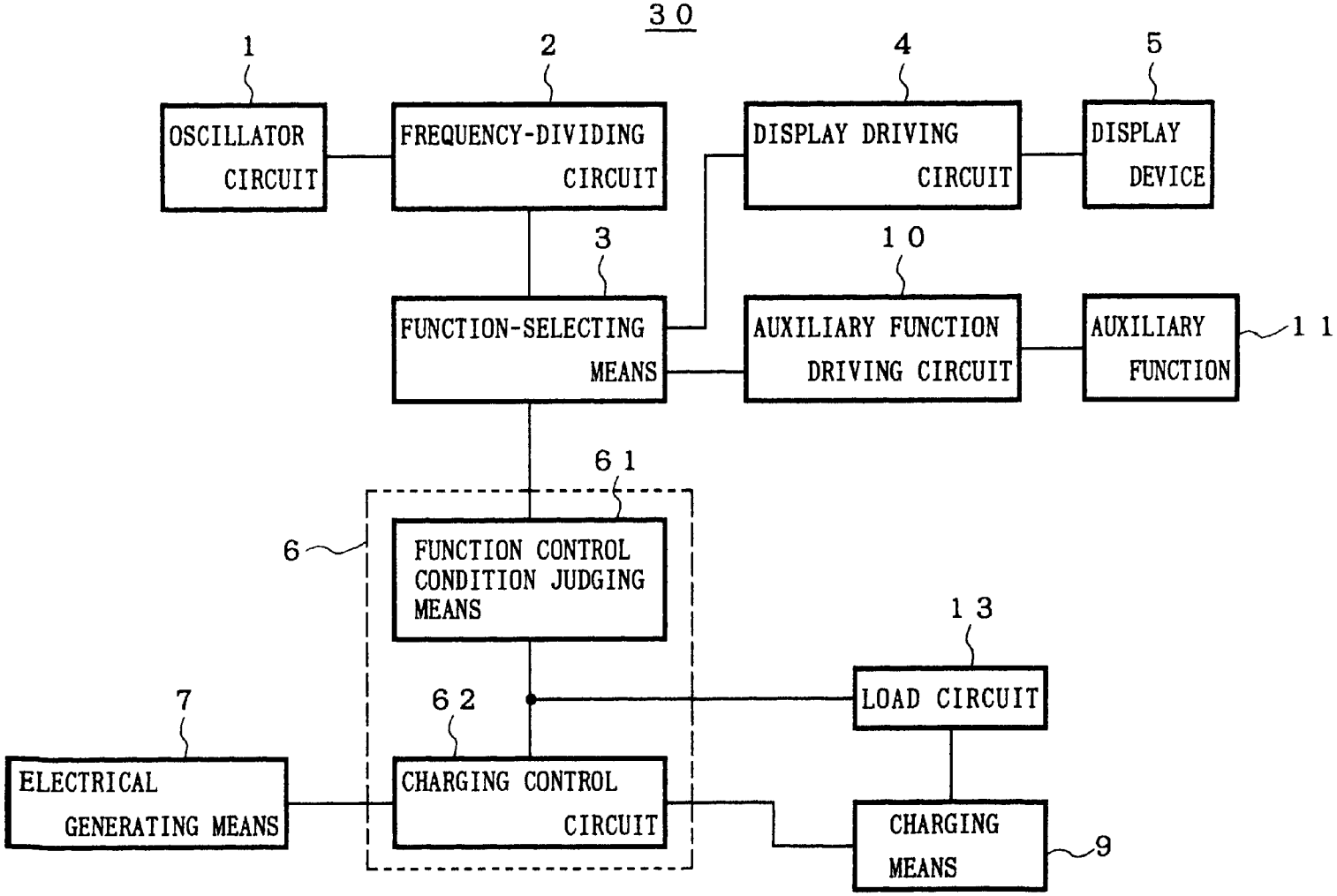
FIG. 3 is a block diagram which shows the general configuration of the third embodiment of an electronic watch having an electric generating means according to the present invention.
Figure 4:
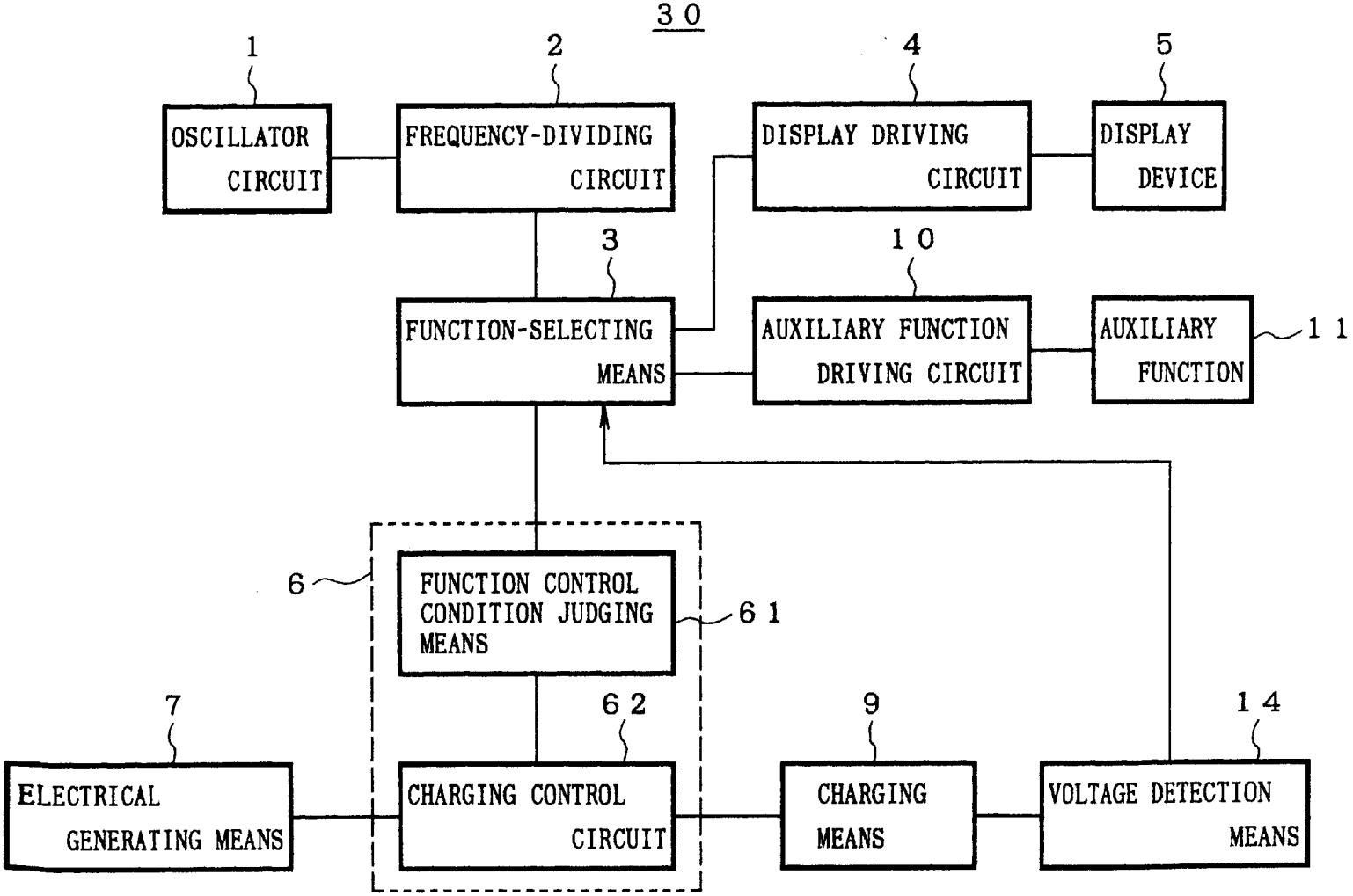
FIG. 4 is a block diagram which shows the general configuration of the fourth embodiment of an electronic watch having an electric generating means according to the present invention.

In FIG. 2 through FIG. 4 which are indicated below, the indication of the reverse-flow preventing means 12 has been omitted.

The external electrical generating means 7 which is used in the present invention can be, for example, a solar cell, and can also be a mechanical means of generating electricity.

The charging means 9 which is used in the present invention can be a battery or a storage battery as have been known in the past, but it is desirable that it be a double-layered capacitor or a secondary cell.

While the above-noted embodiment is described for the case of an analog multifunction electronic watch, it is obvious that the present invention can be applied in the same manner to a digital multifunction electronic watch.

FIG. 2 is a block diagram which shows the configuration of the second embodiment of the present invention. It shows an example of the charging control means 62 that was described with regard to the first embodiment shown in FIG. 1.

Specifically, in the second embodiment of the present invention, in the case in which a command is issued by the function control condition judging means 61 so that a function other than the time display function is executed, rather than completely cutting off the conduction between the external electrical generating means 7 and the charging means 9, the charging control means 62 is configured so as to incompletely cut off the conduction between the external electrical generating means 7 and the charging means 9.

For example, a function which is demanded of the charging control means 62 in the present invention in addition to either completely cutting off the conduction between the external electrical generating means 7 and the charging means 9 or causing complete conducting between the external electrical generating means 7 and the charging means 9, is that of taking on a condition that is intermediate therebetween.

That is, during a time in which a function of the various functions other than the time display function is being displayed in the above-noted electronic watch having an electrical generating function, even if the conduction between the external electrical generating means 7 and the charging means 9 is not completely cut off, from a practical standpoint if the current is somewhat limited, so that there is incomplete cutoff, there are cases in which no particular problem exists. Therefore, it is desirable that the charging control means 62 have a function which enables the adjustment of the degree of conduction between the external electrical generating means 7 and the charging means 9.

For this reason, it is desirable that the charging control means 62 be configured so that it can adjust, in either continuous or stepwise manner, its internal resistance or amount of current flowing therethrough.

That is, the charging control means 62 in the second embodiment of the present invention which is shown in FIG. 2 is one example thereof, and within this charging control means 62 there are provided control switch means 63 in which a plurality of switches SW1, SW2, and SW3 are arranged in parallel, so that when one or more of the switches is selected in response to the output of the function control condition judging means 61, the degree of conduction between the external electrical generating means 7 and the charging means 9 is adjusted, thereby generating a condition of incomplete cutoff therebetween.

That is, in reverse hand movement, in which it is generally affected by the stability of power supply voltage, only one of the control switches of the charging control means 62 is set to on, so that the resistance between the external electrical generating means 7 and the charging means 9 is made large, thereby causing almost complete cutoff of charging.

In contrast to this, in the case in which an auxiliary function such as an alarm function or the like, which does not place a severe demand on power supply voltage stability, is executed, two to three of these switches are set to on, so that the resistance value between the external electrical generating means 7 and the charging means 9 is made small. This arrangement not only causes the stabilization of the power supply voltage, but also enables charging to some degree during the operating of an auxiliary function.

Furthermore, in either of the embodiments of the present invention described above, the charging control means 62 can be provided in series between the external electrical generating means 7 and the charging means 9, and can also be provided in parallel between the external electrical generating means 7 and the charging means 9.

In each of the above-described embodiments, because the voltage variation of the charging means 9 is repeated, a large amount of time is required to obtain a stable storage battery voltage.

For this reason, in the various functions the problem of not obtaining an accurate display occurs, because it is necessary to stabilize the storage battery voltage in a short period of time.

FIG. 3 is a drawing which illustrates another form of an electronic watch having an electrical generating function, this being the third embodiment of the present invention. In this electronic watch 30 having an electrical generating function, there is additionally provided an added load means 13 for the purpose of stabilizing the voltage of the charging means 9 to a prescribed voltage immediately before driving a function that is different from the time display function.

That is, the added load means 13 is provided to the charging means 9, the charging control means 62 being controlled by the output from the function control condition judging means 61, which also causes the added load means 13 to operate so as to quickly stabilize the voltage of the charging means 9.

The added load means 13 used in the present invention can be, for example, either a motor or a resistance.

FIG. 4 is a block diagram which shows an example of the configuration of a fourth embodiment of an electronic watch having an electrical generating function according to the present invention, a feature of this embodiment being the detection of the output voltage of the charging means 9 and the control of the function selecting means 3 so that it controls the currently executed function.

That is, in FIG. 4, there is a voltage detection means 14 provided to detect the output voltage of the charging means 9, and when the voltage of the charging means 9 becomes smaller than a prescribed voltage, it outputs to the function selecting means 3, a prescribed signal, so as to stop an auxiliary function or another function other than the time display function which is currently being executed by the function selecting means 3.

As a specific example, if a drop in the voltage is detected during reverse hand movement, the reverse hand movement is stopped so that the hands are moved forward.

Next, the configuration of the fifth embodiment of a specific example of the electronic watch 30 with an electrical generating function will be described, with reference being made to FIG. 5.

Figure 5:
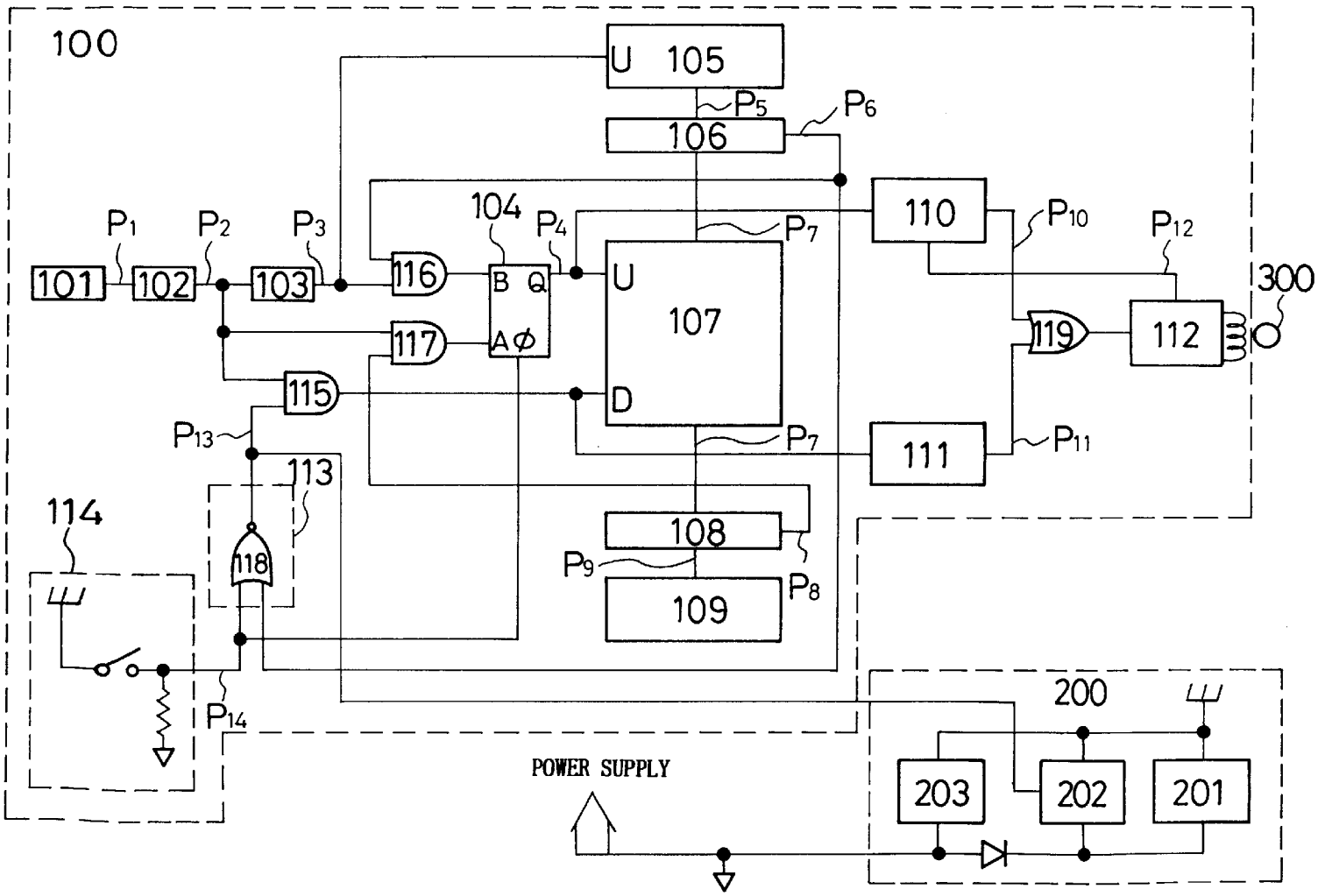
FIG. 5 is a block diagram which shows the general configuration of the fifth embodiment of an electronic watch having an electric generating means according to the present invention.

FIG. 5 is a block diagram of an analog multifunction watch 400, in which 100 is a watch circuit, 200 is a power supply, and 300 is a motor.

The watch circuit 100 is formed by a reference timebase 101, a first frequency-dividing means 102, and second frequency-dividing means 103, a selector 104, a time counter 105, a coincidence circuit 106, a hand position counter 107, a non-coincidence circuit 108, an alarm counter 109, a forward pulse generating circuit 110, a reverse pulse generating circuit 111, a driver 112, a reverse control means 113, a mode-selecting switch 114, AND gates 115, 116, and 117, and an OR gate 119.

The reference timebase 101 generates a reference signal P1 of 32.768 kHz the first frequency-dividing means 102 inputs this reference signal P1, divides it in 12 stages, and outputs the resulting 8-kHz signal as the signal P2, and the second frequency-dividing means 103 inputs this 8-kHz signal P2, divides it in 3 stages, and outputs the resulting 1-Hz signal P3.

The AND gate 116 outputs this 1-Hz signal P3 only while the coincidence signal P6 from the coincidence circuit 106, to be described later, is at the high level. In the same manner, the AND gate 117 outputs the 8-kHz signal P2 only while the non-coincidence signal P8 from the non-coincidence circuit 108 is at the high level.

The AND circuit 115 outputs a count down signal P15 having 8-kHz, only while a reverse control signal P13 from the reverse control means 113, to be described later, is at the high level.

The B input of the selector 104 is the 1-Hz signal P3 via the AND gate 116, the A input thereof is the 8-kHz signal P2 via the AND gate 117, and the ϕ input thereof is the mode-selecting signal P14 from the mode-selecting switch 114.

When the mode-selecting signal P14 is at the low level, the B input is selectively output from the Q output, as a count up signal P4, and when the mode-selecting signal P14 is at the high level, the A input is selectively output from the Q output, as a count up signal P4.

The time counter 105 is an up counter, the 1-Hz signal P3 being input at the U terminal thereof, this counter performing a count of the current time.

The hand position counter 107 is an up counter, at the U terminal of which is input either the 1-Hz or 8-kHz count-up signal P4 from the selector 104, and at the D terminal of which is input the 8-Hz count down signal P4 from the AND gate 115, this counter performing counting of the hand position.

The alarm counter 109 is an up counter, which holds the alarm time.

The coincidence circuit 106 detects coincidence between the count value P5 of the time counter 105 and the count value P7 of the hand position counter 107, outputting a coincidence signal P6 at the high level if there is coincidence, and at the low level if there is non-coincidence therebetween. The non-coincidence circuit 108 detects non-coincidence between the count value P7 of the hand position counter 107 and the count value P9 of the alarm counter 109, outputting a non-coincidence signal at the high level if there is non-coincidence and at the low level if there is coincidence therebetween.

The forward pulse generating circuit 110 generates a forward pulse P10 each time the count-up signal P4 from the selector 104 is input, and the reverse pulse generating circuit 111 outputs a reverse pulse P11 each time the count-down signal P15 is input from the AND gate 115.

The driver 112 inputs, via the OR gate 19, either the forward pulse P10 from the forward pulse generating circuit 110 or the reverse pulse P11 from the reverse pulse generating circuit 111.

The reverse starting pulse P12 for load compensation from the motor 300 is input to the forward pulse generating circuit via the driver 112.

The reverse control circuit 113 is formed by a NOR gate 118, which inputs the mode-selecting signal P14 from the mode-selecting switch 114 and the coincidence signal P6 from the coincidence circuit 106, outputting a high-level reverse control signal P13 only when both the mode-selecting signal P14 and the coincidence signal P6 are at the low level.

That is, until return is made from the alarm mode to the time mode and the hand position is returned to the current time, a high-level reverse control pulse signal P13 is output.

When the mode-selecting switch 114 is off, a low-level mode-selecting signal P14 is output, and when it is on, a high-level mode-selecting signal P14 is output. When the mode-selecting signal P14 is at the low level, the time mode is at the high level, and the alarm mode is enabled.

The power supply circuit 200 is formed by an electrical generating means 201 which corresponds to the external electrical generating means 7 in other previously described embodiments, a charging prohibiting means 202 which corresponds to the charging condition control means 6 therein, a charging means 201 which corresponds to the charging means 9, and a reverse-flow preventing diode 204.

The charging prohibiting means 202 is formed by a switching element, and in the case such as shown in FIG. 5, in which it is connected in parallel with the electrical generating means 203 and the charging means 201, this is set to on when the reverse control signal P13 is at the high level.

Although it is omitted from the drawing, it is also possible to connect the charging prohibiting means 202 in series with a connecting point formed between the electrical generating means 203 and the charging means 201.

In this case, control can be performed so that the charging preventing means 202 is in the off condition, when the reverse control signal P13 is at the high level.

The energy from the electrical generating means 203 is stored in the charging means 201 via the reverse-flow prohibiting diode 204, and when the charging preventing means 202 intervening therebetween inputs the reverse control signal P13 from the reverse control circuit 113, charging is prevented, thereby eliminating circuit power supply variation. Next the operation this embodiment of the present invention will be described.

Because the time correction operation, alarm correction operation, and hand position (zero position) correction operation are not directly related to the present invention, these will be omitted from the description.

First, normal operation will be described.

In normal operation, the mode-selecting switch 114 is off, so that a low-level mode-selecting signal P14 is output, and the mode is selected as the time mode. A 1-kHz signal P3 is input to the time counter 5.

Because a low-level mode-selecting signal P14 is input to the ϕ input of the selector 104, the 1-kHz signal P3 is selected via the AND gate 116 and output as the count-up signal P4.

The count-up signal P4 is input to the hand position counter 107 and to the forward pulse generating circuit 110. The forward pulse drive pulse P10 is output from the forward pulse generating circuit 110 at 1 Hz, which drives the motor 300 via the driver 112.

Because the counter value P5 of the time counter 105 and the count value P7 of the hand position counter 107 coincide, a high-level coincidence signal P6 is output from the coincidence circuit 106.

Also, because the reverse control circuit 113 inputs the low-level mode-selecting signal P14 and the high-level coincidence signal P6, it outputs a low-level reverse control signal P13.

Therefore, in normal operation the energy from the electrical generating means 203 is continuously stored in the charging means 201 via the reverse-flow preventing diode 204.

Next, the operation of transition from the time mode to the alarm mode will be described.

In the time mode, because there in non-coincidence between the count value P7 of the hand position counter 107 and the count value P9 of the alarm counter 109, a high-level non-coincidence signal P8 is output from the non-coincidence circuit 108.

In this condition, if the mode-selecting switch 114 is set to on, a high-level mode-selecting signal P14 is output.

Because a high-level mode-selecting signal P14 is input to the ϕ input of the selector 104, the 8-Hz signal P2 is selected via the AND gate 117.

Also, because a high-level mode-selecting signal P14 is input to the reverse control circuit 113, it output a low-level reverse control signal P13.

Although the 1-Hz signal P3 continues to be input to the time counter 105, the 8-Hz count-up signal P4 is input to the hand position counter 107 and to the forward pulse generating circuit 110.

When the hand position counter 107 is counted up at every 8 Hz, and when the count value P9 of the alarm counter 109 coincides with the count value P7, a low-level non-coincidence signal P8 is output from the non-coincidence circuit 108, and the 8-Hz signal P2 is stopped by the AND gate 117. Simultaneously, forward pulse P10 which is output from the forward pulse generating circuit 110 generated at every 8 Hz also stops, the hand position becoming the alarm setting time.

A low-level reverse control signal P13 is output from the reverse control circuit 113, and when transitioning from the time mode to the alarm or even in the alarm mode, the energy from the electrical generating means 203 continues to be stored, via the reverse-flow preventing diode 204, in the charging means 201.

Next, the operation of transition from the alarm mode to the time mode will be described.

In the alarm mode, because there is coincidence between the count value P7 of the hand position counter 107 and the count value P9 of the alarm counter 109, a low-level non-coincidence signal P8 is output from the non-coincidence circuit 108.

Also, because there is non-coincidence between the count value P5 from the time counter 105 and the count value P7 from the hand position counter 107, a low-level coincidence signal P6 is output from the coincidence circuit 106.

In this condition, if the mode-selecting switch 114 is set to off, because a low-level mode-selecting signal P14 of the reverse control circuit 113 and a low-level coincidence signal P6 are input, the reverse control circuit 113 outputs a high-level reverse control signal P13.

To the hand position counter 107, an 8-Hz count-down signal P15 is input via the AND gate 115.

Because a low-level mode-selecting signal P14 is input to the ϕ input of the selector 104, the AND gate 116 is selected, but because the coincidence signal P6 is at the low level, there is no output of the count-up signal P4.

While there is continued input of the 1-Hz signal P3 to the time counter 105, the 8-Hz count-down signal P15 is input to the hand position counter 107 and the reverse pulse generating circuit 111.

When the hand position counter 107 is counted down at every 8 Hz, and the when the count value P7 of the hand position counter 107 and count value P9 of the alarm counter 109 are in non-coincidence, a high-level non-coincidence signal P8 is output from the non-coincidence counter 108.

Additionally, the hand position counter 7 counts down, and when the count value of the hand position counter 107 coincides with the count value of the time counter 107, a high-level coincidence signal P6 is output from the coincidence circuit 106.

Next, the reverse control signal P13 from the reverse control circuit 113 is switched from high to low, the count-down signal P15 being stopped by the AND gate 115. The result of this is that the reverse pulse P11 from the reverse pulse generating circuit 111 also stops, the hand position indicating the current time.

Simultaneously, a 1-Hz signal P3 is output via the AND gate 116. This is input, via the selector 4, as the count-up signal P4 to the hand position counter 107 and the forward pulse generating circuit 110.

When the reverse control circuit 113 inputs a low-level mode-selecting signal P14 and a low-level coincidence signal P6, it outputs a high-level reverse control signal P13, and when a low-level mode-selecting signal P14 and a high-level coincidence signal P6 are input, it outputs a low-level reverse control signal P13.

Therefore, only when transitioning from the alarm mode to the time mode, energy from the electrical generating means 203 is not stored in the charging means 201 because of the charging prohibiting means 202, so that the voltage variation does not occur.

As described above, in the present invention the charging prohibiting means 202 is caused to operate only when the reverse pulse P11 is output, so that there is no storage of energy from the electrical generating means 203 in the charging means 201.

In this condition of this embodiment, when transitioning from the alarm mode to the time mode, a reverse pulse is output and the charging prohibiting means 202 is caused to operate, the present invention is not restricted in this manner, it being also possible to have a configuration which operates so that the charging prohibiting means 202 is caused to operate when using a reverse pulse, without regard to the transition of the mode.

Therefore, the present invention includes a configuration in which even when the reverse pulse is output because of a correction operation, the charging prohibiting means 202 is caused to operate in the same manner, so that a variation in voltage does not occur.

In the present invention, there is no limitation with regard to the use of the reverse pulse, it being effective when, for example, a fast-forward pulse is used, without performing load compensation.

Next, the sixth embodiment of an electronic watch 30 having an electrical generating function will be described, with reference being made to FIG. 6.

Figure 6:
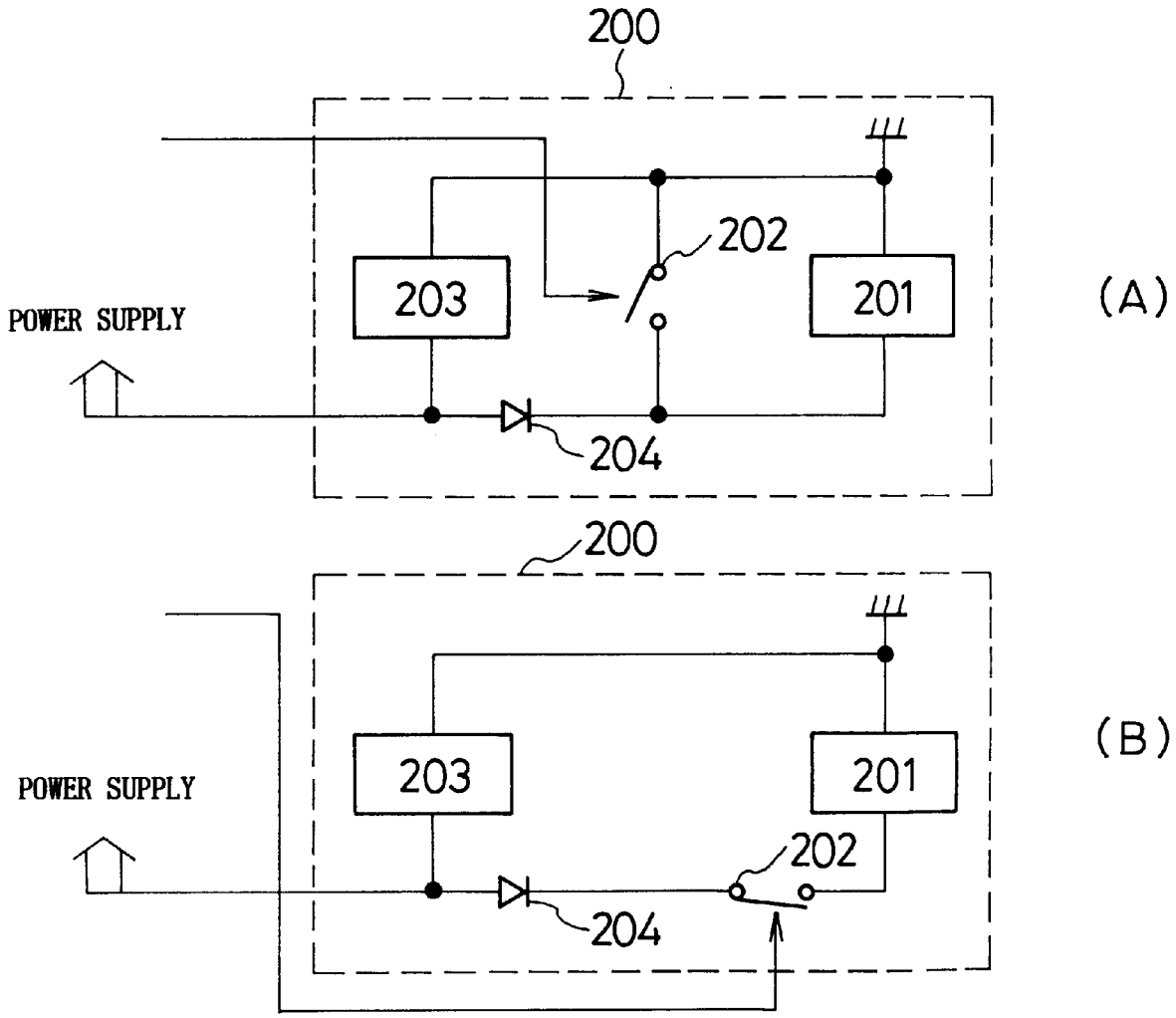
FIG. 6 is a block diagram which shows the general configuration of the sixth embodiment of an electronic watch having an electric generating means according to the present invention.

In the sixth embodiment of the present invention shown in FIG. 6, there is illustrated a specific example of the power supply 200 which is shown in FIG. 5, FIG. 6(A) illustrating an example in which the charging control circuit 202, which corresponds to the charging condition control means 6, is connected in parallel with the charging means 201, which corresponds to the charging means 9. In this case, the charging control circuit 202 is normally off, and is changed to the on condition by means of the signal P13 which is shown in FIG. 5.

In FIG. 6(B), the example illustrated is one in which the charging control circuit 202, which corresponds to the charging condition control means 6, is connected in series with the charging means 201, which corresponds to the charging means 9. In this case, the charging control circuit 202 is normally on, and is changed to the off condition by means of the signal P13 which is shown in FIG. 5.

Figure 7:
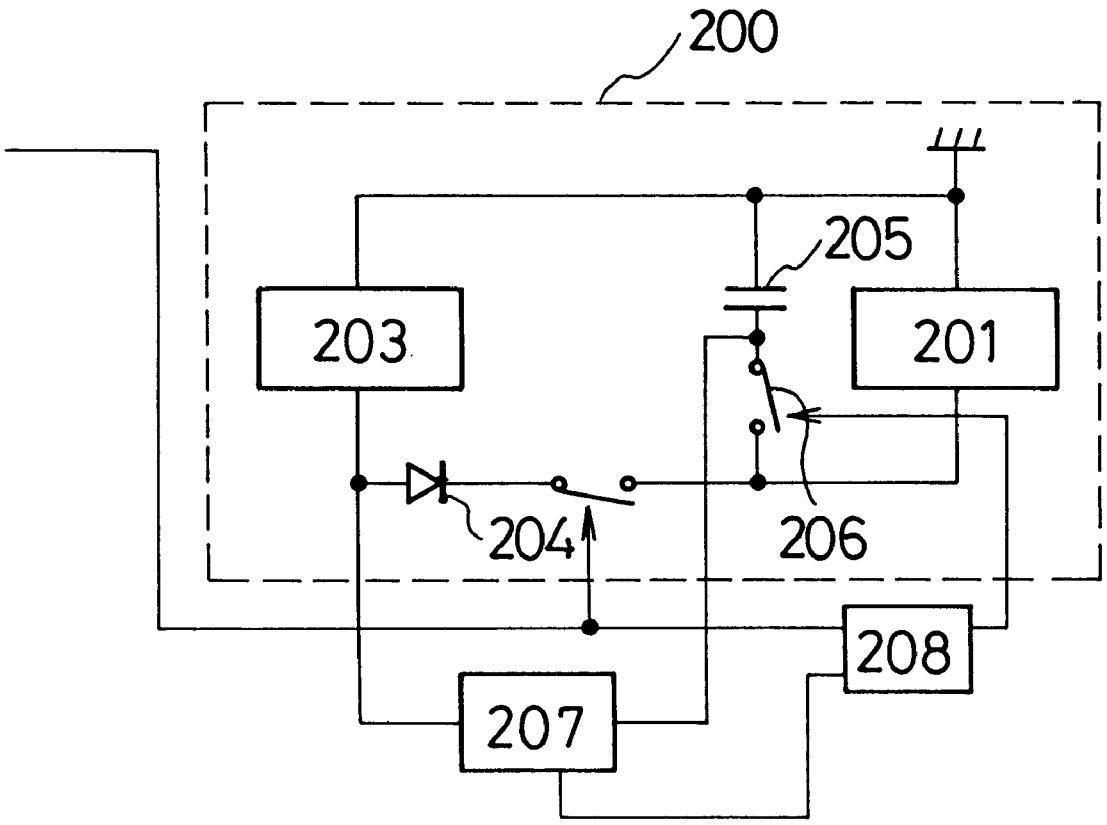
FIG. 7 is a block diagram which shows the general configuration of the seventh embodiment of an electronic watch having an electric generating means according to the present invention.

FIG. 7 shows, in the case of the configuration of the electronic watch 400 with an electrical generating function which is shown in FIG. 6, the provision of means for storing voltage generated at electric power generating means 200, in a capacitor 205, which is a second charging means between the external electrical generating means 203 and the charging means 201, a voltage that is generated by the electrical generating means 203 during charging cutoff.

That is, the basic configuration of the present invention is such that, during the time in which a function other than the time display function is being executed as noted above, the electrical energy generated by the external electrical generating means 7 (203) is prevented from charging the charging means 9 (201).

However, because there is a problem with merely discarding the generated electrical energy, the configuration is made so as to temporarily storing this electrical energy in a separately provided, relatively small charging means, this being used later as required.

That is, in an electronic watch having an electrical generating function according to the present invention, there is the further provision of a capacitor 205 which is charged by either all of or part of the electrical energy which is prevented from charging the charging means 9 by the charging condition control means 6.

In FIG. 7, when the external electrical generating means 203 and the charging means 201 are cutoff by the charging prohibiting means 202, a switch control circuit 208, based on the signal P13 in FIG. 5, sets the switch 206 to the on condition, thereby causing charging of the capacitor 205 by the external electrical generating means 203.

Then when, for example, reverse hand movement ends, when the charging cutoff condition ends, electrical charge is stored from the capacitor 205 into the charging means 201.

When the voltage on the capacitor 205 and the charging means 201 become equal, a voltage comparing means 207 outputs a control signal, the switch control circuit 208 setting the switch 206 to off, based on this signal.

As described above, according to the present invention, by providing a charging prohibiting means that performs control so that electrical energy generated from an external electrical generating means does not charge a charging means, in accordance with a reverse control means, there is a great effect in eliminating voltage variations and in improving the rotational reliability of the reverse pulse.

What is claimed is:

1. An electronic watch having an electrical generating function which comprises:

function selecting means for selectively causing operation of either a time display function or another function other than said time display function;

external electrical generating means for generating electrical energy;

charging means which stores said electrical energy generated by said external generating means; and charging condition control means which, in response to at least one selection signal output from said function selecting means which selects a function other than said time display function, performs control of a charging condition in said charging means which is charged by said generated electrical energy from said external electrical generating means.

2. An electronic watch having an electrical generating function according to claim 1, wherein said time display function is displayed by means of an indicating hand.

3. An electronic watch having an electrical generating function according to claim 2, wherein when said function other than said time display function is displayed, a load compensation system of said indicating hand is in a non-operating condition.

4. An electronic watch having an electrical generating function according to either claim 2 or claim 3, wherein said function differing from said time display function is at least one function selected from such functions as an indicating hand fast-forward movement function, an indicating hand reverse movement function, an indicating hand fast-reverse movement function, and alarm function, a chronograph display function, a timer function, a stopwatch function, and a radio signal receiving function.

5. An electronic watch having an electrical generating function according an any one claim of claims 1 through 3, wherein said external electrical generating means is a solar cell.

6. An electronic watch having an electrical generating function according to any one of claims 1 through 3, wherein said external generating means is a mechanical-type electrical generating means.

7. An electronic watch having an electrical generating function according to any one of claims 1 through 3, wherein said charging means is a two-layer capacitor.

8. An electronic watch having an electrical generating function according to any one of claims 1 through 3, wherein said charging means is a secondary cell.

9. An electronic watch having an electrical generating function according to any one of claims 1 through 3, wherein said charging condition control means is connected in series between said external electrical generating means and said charging means.

10. An electronic watch having an electrical generating function according to any one of claims 1 to 3, wherein said charging condition control means is connected in parallel between said external electrical generating means and said charging means.

11. An electronic watch having an electrical generating function according to any one of claims 1 to 3, wherein said charging condition control means is configured so as to prevent either all of or a part of the electrical energy generated by said external electrical generating means from charging said charging means.

12. An electronic watch having an electrical generating function according to any one of claims 1 to 3 further comprising added load means for the purpose of stabilizing the voltage of said charging means to a prescribed voltage immediately before driving a function other than said time display function.

13. An electronic watch having an electrical generating function according to claim 12, wherein said added load means is formed by either a motor or a resistance.

14. An electronic watch having an electrical generating function according to any one of claims 1 to 3 further comprising added charging means which stores either a part of or all of the electrical energy generated by said external electrical generating means which is prevented from charging said charging means by said charging condition control means.

15. An electronic watch having an electrical generating function according to any one of claims 1 to 3 further comprising voltage detection means, and wherein when the voltage of said charging means falls to below a prescribed value, said selected function other than said time display function is stopped.

* * * * *